US009088098B2

(12) United States Patent
Hwang

(10) Patent No.: US 9,088,098 B2
(45) Date of Patent: Jul. 21, 2015

(54) TERMINAL CONNECTING SYSTEM

(71) Applicant: Samsung Electronics Co., Ltd., Gyeonggi-do (KR)

(72) Inventor: Sunlyeong Hwang, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 42 days.

(21) Appl. No.: 14/093,770

(22) Filed: Dec. 2, 2013

(65) Prior Publication Data

US 2014/0170864 A1 Jun. 19, 2014

(30) Foreign Application Priority Data

Dec. 14, 2012 (KR) ..... 10-2012-0146591

(51) Int. Cl.

| | |
|---|---|
| ***H01R 11/30*** | (2006.01) |
| ***H01R 13/62*** | (2006.01) |
| ***H01R 13/633*** | (2006.01) |
| *H01R 13/24* | (2006.01) |
| *H01R 13/635* | (2006.01) |

(52) U.S. Cl.

CPC ..... *H01R 13/6205* (2013.01); *H01R 13/633* (2013.01); *H01R 13/24* (2013.01); *H01R 13/635* (2013.01); *H01R 2201/16* (2013.01)

(58) Field of Classification Search

CPC ..... H01R 39/64; H01R 27/00
USPC ..... 439/39, 218, 217, 700, 38
See application file for complete search history.

(56) References Cited

U.S. PATENT DOCUMENTS

| | | | | |
|---|---|---|---|---|
| 5,691,863 | A * | 11/1997 | Takayanagi | 360/272 |
| 6,183,264 | B1 | 2/2001 | Harsanyi | |
| 6,517,357 | B1 * | 2/2003 | Athanasiou et al. | 439/26 |
| 6,981,887 | B1 * | 1/2006 | Mese et al. | 439/244 |
| 7,762,817 | B2 * | 7/2010 | Ligtenberg et al. | 439/38 |
| 2007/0072443 | A1 | 3/2007 | Rohrbach et al. | |
| 2009/0174990 | A1 * | 7/2009 | Ligtenberg et al. | 361/679.01 |

FOREIGN PATENT DOCUMENTS

| | | |
|---|---|---|
| EP | 2 434 131 A2 | 3/2012 |
| FR | 2 918 216 A1 | 1/2009 |
| FR | 2 938 383 A1 | 5/2010 |

* cited by examiner

*Primary Examiner* — Phuongchi T Nguyen
(74) *Attorney, Agent, or Firm* — Cha & Reiter, LLC

(57) ABSTRACT

An electronic device is provided comprising a connection interface including a connection portion; and a fastening portion comprising a plate that is configured to: (i) be substantially flush with a surface of the electronic device when the connection interface and a connector are not mated, and (ii) extend or recede from the surface of the electronic device when the connection interface and the connector are mated.

12 Claims, 12 Drawing Sheets

TERMINAL CONNECTING SYSTEM

CLAIM OF PRIORITY

This application claims the benefit under 35 U.S.C. §119 (a) of a Korean patent application filed on Dec. 14, 2012 in the Korean Intellectual Property Office and assigned Serial No. 10-2012-0146591, the entire disclosure of which is hereby incorporated by reference.

BACKGROUND

1. Field of the Disclosure

The present disclosure relates to a connecting structure of a terminal, and more particularly, to a terminal connecting system.

2. Description of the Related Art

Mobile terminals, in general, are battery-powered and they include connecting interfaces, such as Universal Serial Bus (USB) ports or 2.1 mm barrel connectors, for charging their batteries. Such connecting interfaces ordinarily form a groove in a portion of the external enclosures of the terminals and employ a structure in which a protruded connector or a charging cable is inserted. However, because various foreign substances can enter the grooves, connecting interfaces can be susceptible to damage due to the accumulation of dust or other materials in them. Furthermore, the use of connecting interfaces makes the design of mobile terminals more difficult, as the portions of the terminals' enclosures where the connection interface's grooves are situated can become more sensitive to mechanical shocks or pressure.

Accordingly, the need exists for new mobile terminal connecting interfaces.

SUMMARY

The present disclosure addresses this need. According to one aspect of the disclosure, an electronic device is provided comprising a connection portion; and a fastening portion comprising a plate that is configured to: (i) be substantially flush with a surface of the electronic device when the connection interface and a connector are not mated, and (ii) extend or recede from the surface of the electronic device when the connection interface and the connector are mated.

According to another aspect of the disclosure, a connector is provided, including: a connection portion; and a fastening portion comprising a plate configured to extend or recede from a surface of the connector when the connector is mated with a connection interface.

According to yet another aspect of the disclosure, a connecting system for use in an electronic device, including: a connection interface comprising a first plate; a connector for mating with the connection interface, comprising a second plate configured to protrude or extend from a surface of the connector; wherein the first plate is configured to: (i) be substantially flush with a surface of the electronic device when the connector and the connection interface are not mated, and (ii) extend or recede from the surface of the electronic device during a mating of the connection interface with the connector.

According to yet another aspect of the disclosure, a method of operating a terminal is provided, the method including detecting a contact between a connection interface of the terminal and a connector; and responsive to detecting the contact, moving a first plate that is substantially flush with a terminal case surface to extend or recede from the terminal case surface.

BRIEF DESCRIPTION OF THE DRAWINGS

The above features and advantages of the present disclosure will be more apparent from the following detailed description in conjunction with the accompanying drawings, in which.

DETAILED DESCRIPTION

Figure 1:
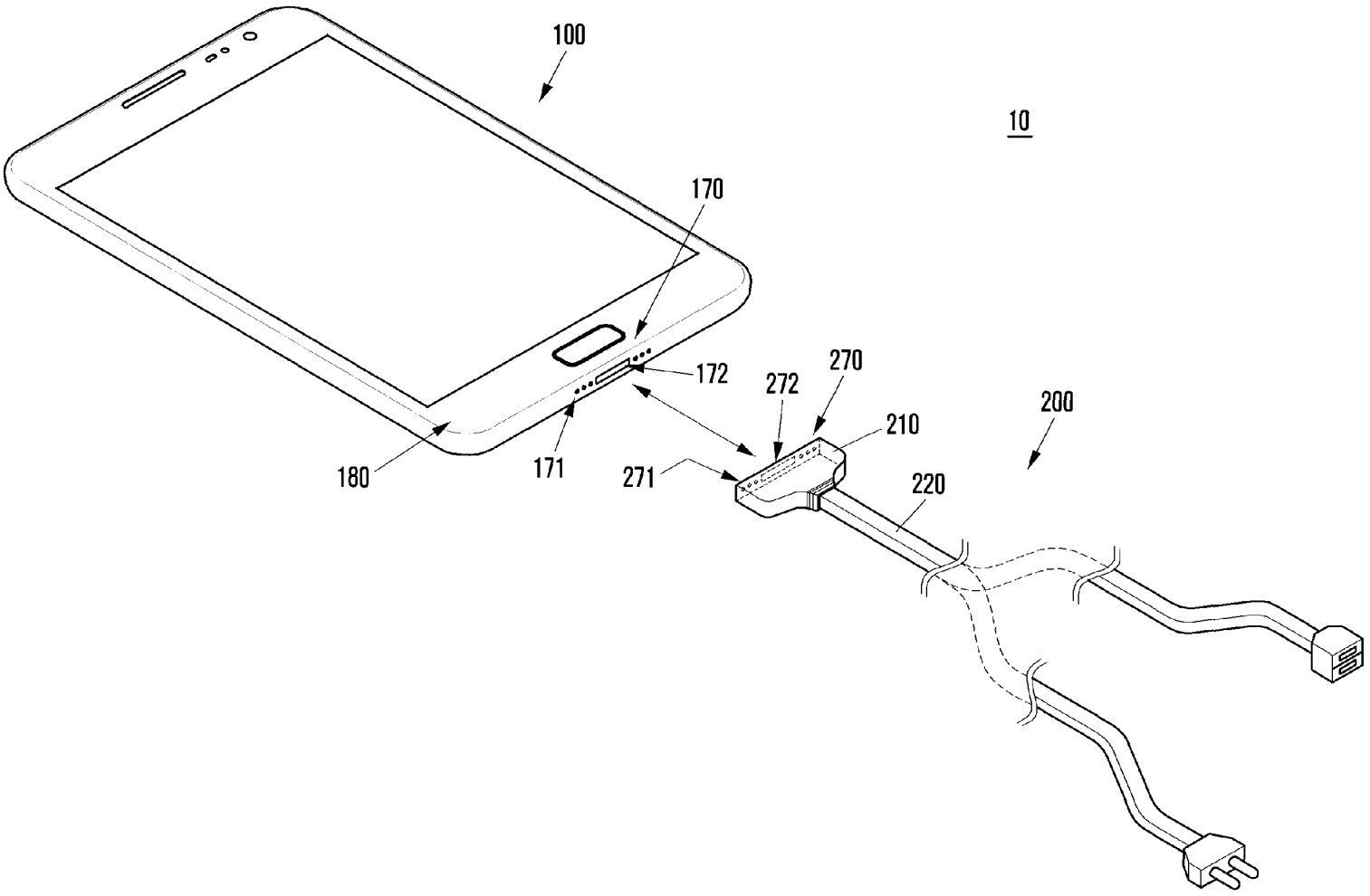
FIG. 1 is a perspective view of a connecting system of a terminal according to aspects of the present disclosure.

Hereinafter, various examples are described in detail with reference to the accompanying drawings. The same reference numbers are used throughout the drawings to refer to the same or like parts. The views in the drawings are schematic views only, and are not intended to be to scale or correctly proportioned. Detailed descriptions of well-known functions and structures incorporated herein may be omitted to avoid obscuring the subject matter of the present disclosure.

FIG. 1 is a perspective view of a connecting system 10 of a terminal 100 according to aspects of the present disclosure. The connecting system 10 includes a pogo connector 200 and a terminal 100 to which the pogo connector 200 is connected.

The connecting system 10 is configured so that the connector interface 170 is flush with the wall of the terminal where the connection interface 170 is placed, as shown in FIG. 1. When the pogo connector 200 is connected to the terminal 100, a movable plate constituting the connection interface 170 is extended or receded from a surface of the terminal 100 to support a coupling to the pogo connector 200. Accordingly, before the pogo connector 200 is connected, the surface of the terminal 100 where the connection interface 170 is disposed is maintained without protrusion or depression and thus the connecting system 10 has an enhanced external appearance and prevents damage or contamination of the terminal. Further, while the connecting system 10 permits the pogo connector 200 to be safely and securely fastened to the terminal 100, the connecting system 10 is also capable of being mass-produced efficiently.

By connecting to the connection interface 170 provided at one side of the terminal 100, the pogo connector 200 may supply power to the terminal 100 or may supply specific data to the terminal 100. As described above, the pogo connector 200 may be used to connect the terminal 100 to any suitable device, such as a battery charger, a laptop computer, another portable terminal, etc. In order to connect to a terminal fastening portion 172 of the connection interface 170 of the terminal 100, as shown in FIG. 1, the pogo connector 200 includes a pogo plate disposed on one of end of a cable. In some aspects, the pogo connector 200 may include a universal serial bus (USB) port, universal asynchronous receiver/transmitter (UART) port, and or any other suitable connector (e.g., male or female).

Particularly, the pogo connector 200 of the present example includes a connector portion 270 and a cable 220 provided at one side, and at the other side thereof, a power supply cord or a specific port may be provided. The connector portion 270 includes a pogo fastening portion 272 and a pogo connection portion 271 and includes a pogo case 210 enclosing the pogo fastening portion 272 and the pogo connection portion 271. In addition, at one side of the pogo case 210, the cable 220 is connected.

The pogo connection portion 271 makes contact with a terminal connection portion 171 provided in the terminal 100 to permit the transfer of power and/or data to the terminal 100. The pogo connection portion 271 may include a plurality of protrusions protruded to a predetermined height from a surface. In some examples, the plurality of protrusions may include a spring device. When the protrusions are inserted in a groove of the terminal connection portion 171, the spring device may more securely make contact with the terminal connection portion 171.

The pogo fastening portion 272 is connected to the terminal fastening portion 172 of the connection interface 170 provided in the terminal 100 to perform a function of fixing the pogo connector 200 to the terminal 100. The pogo fastening portion 272 may be provided in a fixed form or in a moving form according to various aspects of the present disclosure. Particularly, the pogo fastening portion 272 has the same surface as that of the terminal fastening portion 172 of the terminal 100, includes a pogo plate having a magnetic force, and improves a contact force with a movable plate provided in the terminal fastening portion 172. For this, the pogo fastening portion 272 has a pogo receiving portion in which a pogo plate having a magnetic force is received and employs a structure in which a pogo plate having a predetermined width and thickness is disposed in the pogo receiving portion. Further, as the pogo fastening portion 272 including the pogo plate approaches the connection interface 170, the pogo fastening portion 272 may provide a predetermined magnetic force to a magnetic force detection sensor provided in the connection interface 170. In the above-described illustration, the pogo fastening portion 272 includes a pogo plate, however the present disclosure is not limited thereto. This is, a plate provided in the pogo fastening portion 272 may be formed in a plate of a metal material not having a magnetic force according to a design method.

The terminal 100 includes various constituent elements, such as, for example, a display unit 140 (shown in FIG. 8), a terminal case 180 enclosing the display unit 140, a controller, or a camera module. The camera module may be disposed inside or outside of the terminal case 180. Particularly, at one side of the terminal case 180, the connection interface 170 for connecting the pogo connector 200 is provided. For example, the connection interface 170 may be provided in a predetermined area of a side wall of the terminal case 180. In this case, the connection interface 170 may include the terminal connection portion 171 and the terminal fastening portion 172. The connection interface may be substantially flush with the side wall in which the connections interface 170 is placed.

The terminal connection portion 171 makes contact with the pogo connection portion 271 to perform power reception or communication data transmission and reception of a power supply device or a communication device connected to the pogo connector 200. For this, the terminal connection portion 171 may have a plurality of grooves depressed by a predetermined depth from a surface. A groove formed in the terminal connection portion 171 may be formed in a very small height and may have a depth corresponding to a plurality of protrusions formed in the pogo connection portion 271 or may have a depth lower than a height of the corresponding protrusions.

The terminal fastening portion 172 includes a movable plate of a metal material and a plate driver or an elastic member for moving the movable plate to the outside or the inside of the terminal case 180. Here, the elastic member may be formed in various forms such as a coil spring form, a flat spring form, a leaf spring form, etc. Before being connected to the pogo connector 200, the terminal fastening portion 172 of this example is flush with the side wall of the terminal case 180, so that the plate area and the side wall form one substantially smooth and/or continuous surface. Accordingly, the terminal fastening portion 172 enables the portion of the sidewall of the terminal case 180 where the fastening portion 172 is situated to not be engraved or protruded, relative to the rest of the side wall.

When the pogo connector 200 is connected to the terminal 100, the terminal fastening portion 172 is coupled to the pogo fastening portion 272 provided in the pogo connector 200, and thus a more secured fastening may be provided. A structure of the terminal fastening portion 172 and a structure of the pogo fastening portion 272 are described in detail hereinafter with reference to various examples.

Figure 2:
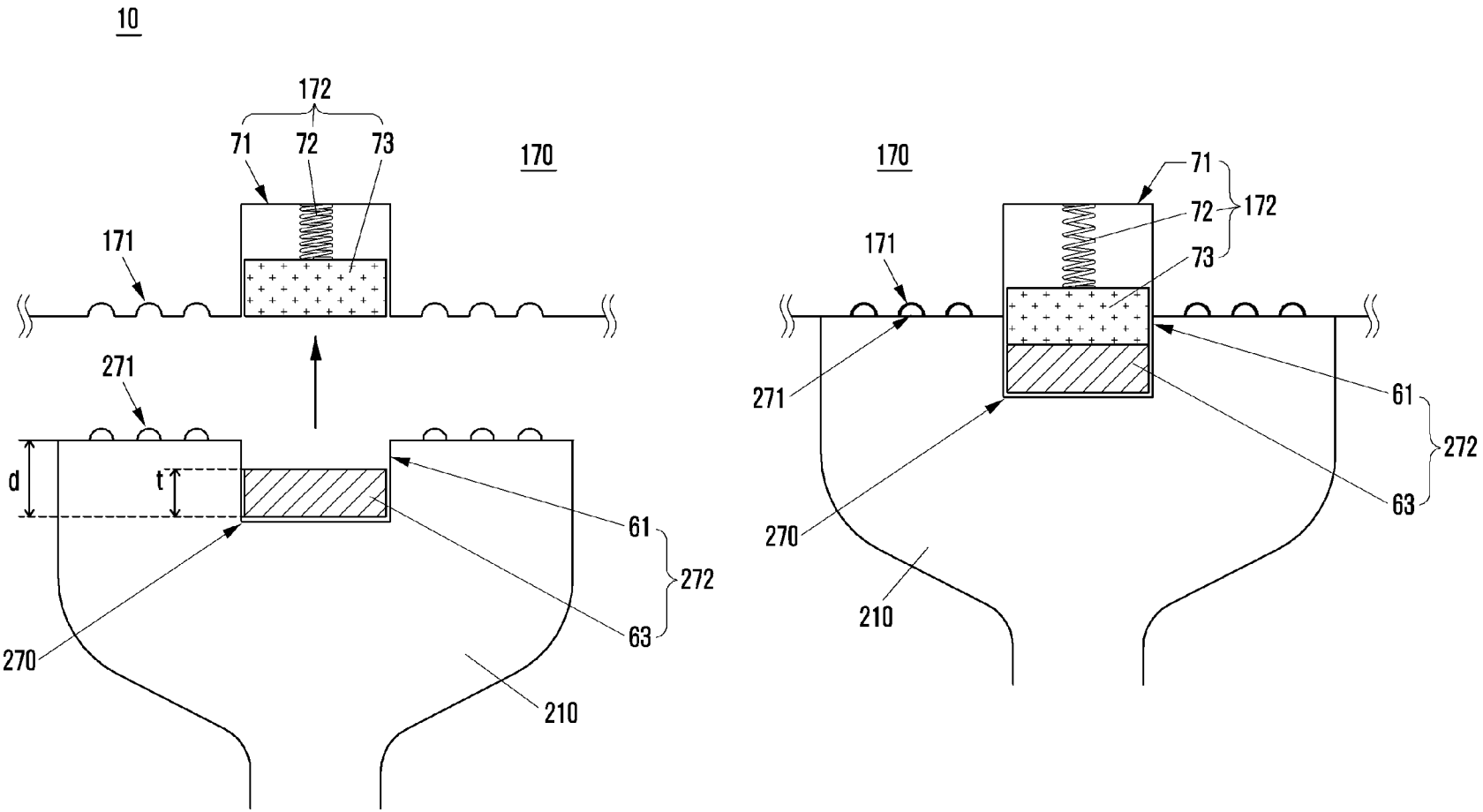
FIG. 2 is a diagram of a connecting structure according to aspects of the present disclosure.

FIG. 2 is a diagram of a structure of the connecting system 10 according to one aspect the present disclosure. In this example, the connection interface 170 includes a terminal connection portion 171 and a terminal fastening portion 172 and the terminal fastening portion 172 includes a terminal receiving portion 71, elastic member 72, and movable plate 73. The terminal receiving portion 71 is engraved in the terminal case to receive the elastic member 72 and the movable plate 73. A front surface of the movable plate 73 is flush with the terminal case. The elastic member 72 is disposed behind a back surface of the movable plate 73, as shown. The movable plate 73 may be made of a metal material and/or a magnetic or magnetized material. For example, the movable plate 73 may be made of a rubber material having a magnetic force. When the pogo connector 200 is mated with the connection interface 170, the movable plate 73 moves to contact with a pogo plate 63 of the pogo connector 200, and when the pogo connector 200 is separated from the connection interface 170, the elastic member 72 provides an elastic force to move the movable plate 73 to an original position in which the movable plate 73 is substantially flush with a surface of the terminal 100. As is further discussed below, in some implementations, the movable plate may be actuated by a magnetic force between the movable plate 73 and at least a portion of the pogo connector 200.

The pogo connector 200 includes a pogo connection portion 271 and a pogo fastening portion 272. The pogo fastening portion 272 includes a pogo plate 63 attached and fixed to a predetermined depth in the engraved pogo receiving portion 61, as shown in FIG. 2. The depth d of the pogo receiving portion 61 is larger than the thickness t of the pogo plate 63, thereby enabling the pogo receiving portion 61 to receive both the pogo plate 63 and the movable plate 73 when the pogo connector 200 is connected to the terminal 100.

When the pogo connector 200 is coupled with the connection interface 170, the movable plate 73 moves into the pogo receiving portion 61 and makes contact with the pogo plate 63. After the movable plate 73 is inserted into the pogo receiving portion 61, as the movable plate 73 is disposed to contact with the pogo plate 63, the connecting system becomes able to securely support the pogo connector 200 and prevent the pogo connector 200 from being easily separated from the connection interface 170.

Thereafter, when the pogo connector 200 is separated from the connection interface 170, the movable plate 73 returns to the terminal receiving portion 71 and again becomes flush with the side wall of the enclosure of the terminal 100. Thus, after the pogo connector 200 is separated, the surface of the terminal case returns to a state in which it is substantially flat, thereby preventing the accumulation of dirt and/or the formation of structural weaknesses in the area of the surface of the terminal 100 where the receiving portion 71 is disposed.

Figure 3:
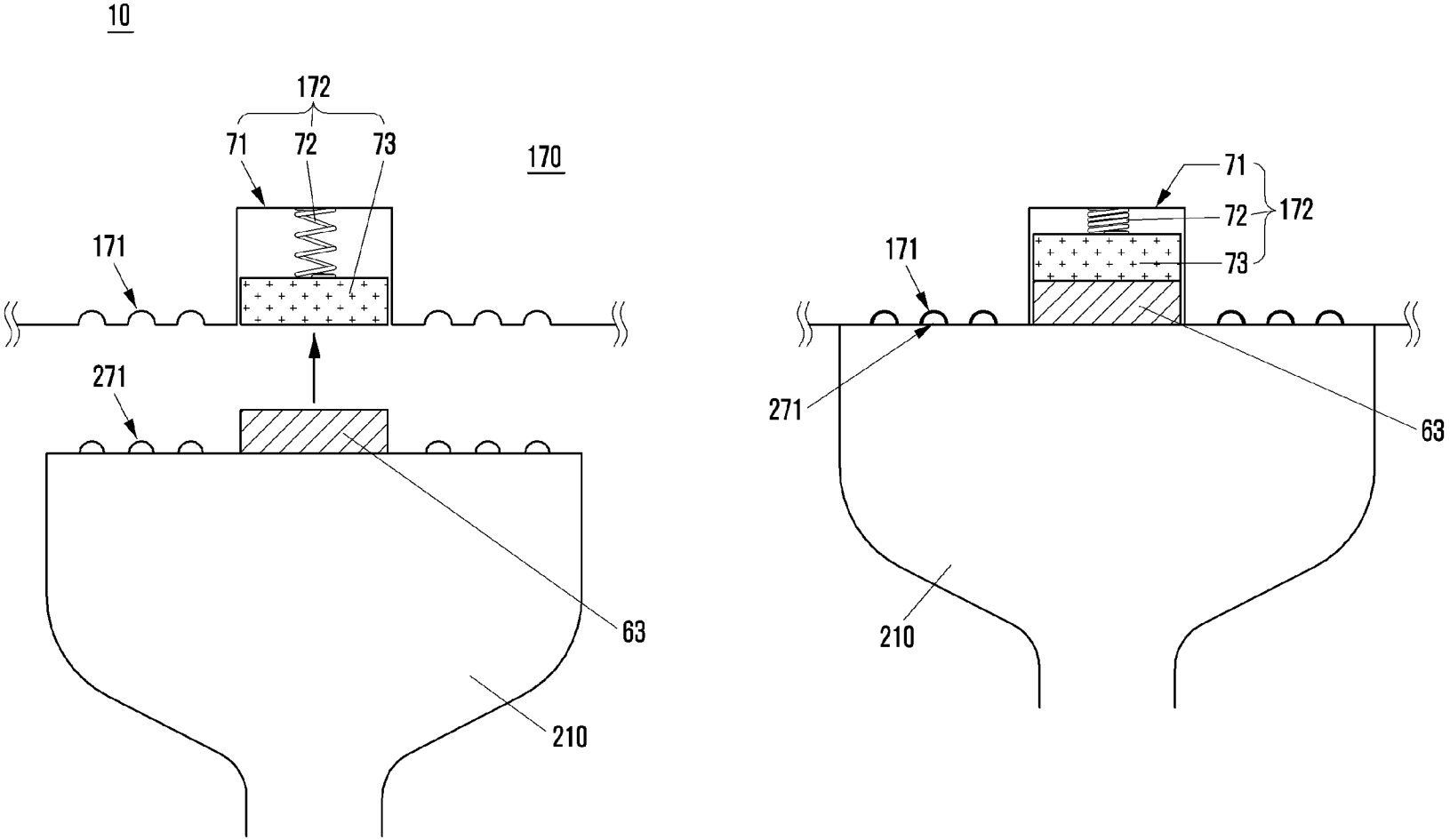
FIG. 3 is a diagram of another connecting structure according to aspects of the present disclosure.

FIG. 3 is a diagram of the connecting system 10 according to another aspect of the present disclosure. According to this example, the connection interface 170 is provided in the same shape as that of the connection interface described with reference to FIG. 2. However, in this example, as illustrated, the pogo plate 63 may be configured to protrude to a predetermined height from a surface of the pogo case 210 while a portion thereof is disposed inside the pogo case 210 in order to attach the pogo plate 63 securely to the pogo case 210. More particularly, the pogo plate 63 may be configured to protrude from a surface of the pogo case 210 by disposing a portion of the pogo plate 63 inside the pogo case 210 and affixing that portion to the pogo case 210 by using an adhesive.

When the pogo connector 200 is mated with the connection interface 170, the pogo plate 63 protruded from the pogo case 210 enters the receiving portion 71 while pushing the movable plate 73 towards the interior of the receiving portion 71. In this case, after the pogo connector 200 is separated, the elastic member 72 returns the movable plate to a state in which the movable plate 73 is flush with a side wall of the terminal case.

When the pogo connector 200 is mated with the connection interface 170, the elastic member 72 may push the pogo plate away from the receiving portion 71. In that regard, to counter the elastic force of the elastic member 72, an inner side surface of the terminal receiving portion 71 may be made from a metal material. When the pogo plate is inserted, the movable plate may be brought closer to the inner side surface to form a magnetic coupling with the side surface having sufficient strength to counter at least some of the elastic force of the elastic member 72 and prevent the elastic member 72 from ejecting the movable plate 73 from the terminal receiving portion 71. By way of example, the movable plate 73 may be made of a metal material for a contact with the pogo plate 63, but in a structure in which the pogo plate 63 is fastened to the terminal receiving portion 71, the pogo plate 63 may be made of various materials of a rubber material, plastic material, or polyurethane material.

Figure 4:
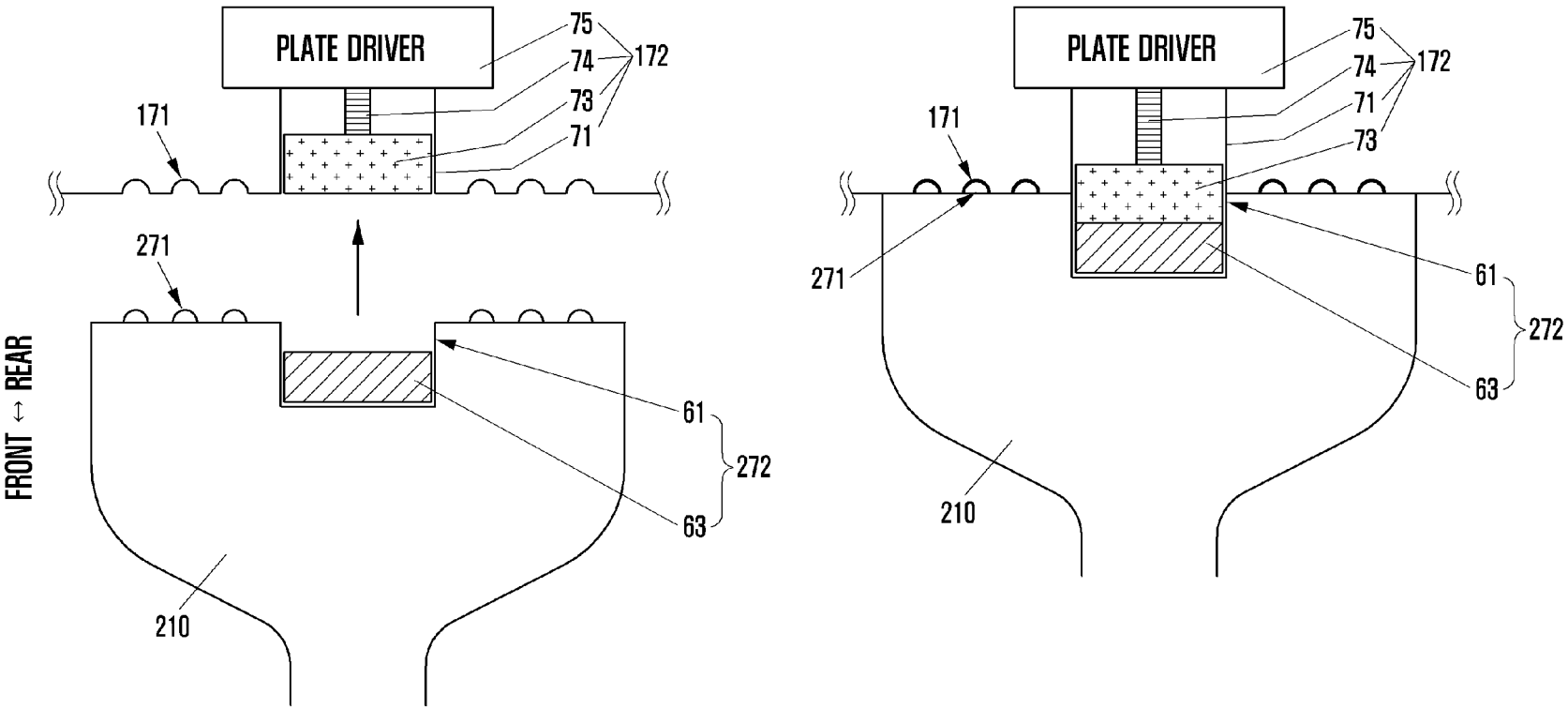
FIG. 4 is a diagram of yet another connecting structure according to aspects of the present disclosure.

FIG. 4 is a diagram of the connecting system 10 in accordance with yet another aspect of the disclosure. In this example, the connecting system is further provided with a moving shaft 74, and plate driver 75.

The plate driver 75 may be configured to actuate the moving shaft 74 and cause the movable plate 73 to retract and extend from the receiving portion 71. In this example, the movable plate 73 may be made of a metal material, and the moving shaft 74 may be operable to push the movable plate 73 to the outside of the terminal case when the moving shaft is actuated by the plate driver 75. Additionally or alternatively, the moving shaft 74 may also be operable to retract the movable plate 73 back into the moving portion 71 after the movable plate 73 has been pushed out. In some implementations, the plate driver 75 may be configured to displace the moving shaft in the front-rear direction.

When the pogo connector 200 is not connected with the connection interface 170, the plate driver 75 adjusts a length of the moving shaft 74 in order to dispose the movable plate 73 to be flush with a surface of the terminal case. In a state in which the pogo connector 200 is connected with the connection interface 170, the plate driver 75 adjusts a length of the moving shaft 74 so that the movable plate 73 is protruded from a surface of the terminal case to contact the pogo plate 63 of the pogo connector 200.

Accordingly, when the pogo connector 200 is connected with the connection interface 170, the movable plate 73 is protruded from a surface of the terminal case to enter the pogo receiving portion 61 and make contact with the pogo plate 63. Once the movable plate 73 has entered the receiving portion 61, the pogo plate 63 and the movable plate 73 may form a magnetic bond, thereby preventing the pogo connector 200 from being separated from the connection interface 170.

Figure 5:
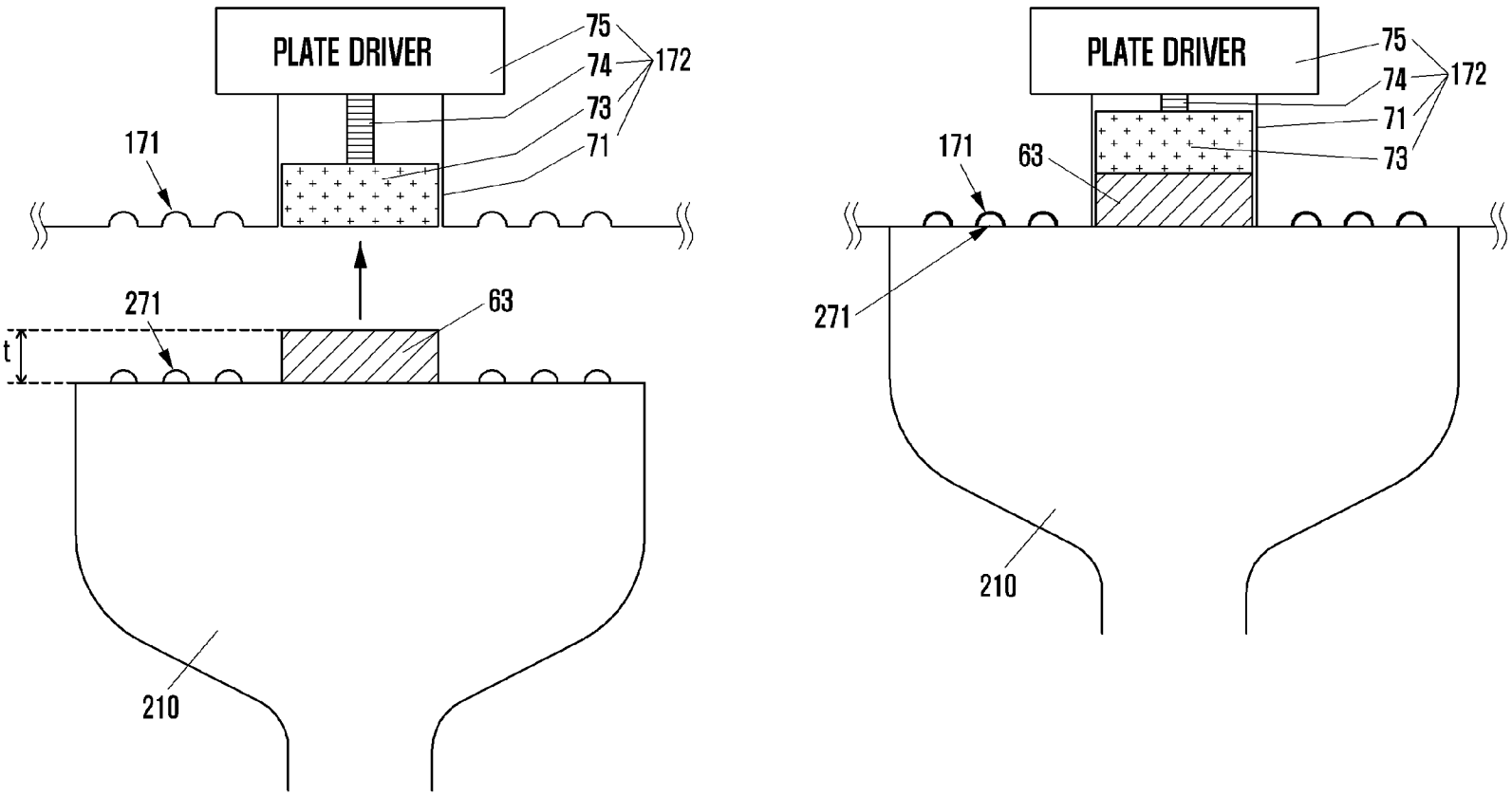
FIG. 5 is a diagram of yet another connecting structure according aspects of the present disclosure.

FIG. 5 is a diagram of the connecting system 10 according yet another aspect of the disclosure. In this example, the movable plate 73 may move only within the terminal receiving portion 71, in contrast to the movable plate in the example of FIG. 4 which is capable of extending outside of the terminal receiving portion. In some implementations, the terminal receiving portion 71 may be deeper than the terminal receiving portion of the example presented with respect to FIG. 4, so as to permit the movable plate 73 to move within the terminal receiving portion 71, The pogo connector 200 in this example includes a pogo fastening portion formed with the pogo connection portion 271 and the pogo plate 63. The pogo plate 63, as illustrated, is configured to protrude from a surface of the pogo case 210. In some implementations, a portion of the pogo plate 63 may be disposed inside the pogo case 210.

When the pogo connector 200 is connected with the connection interface 170 of the terminal, the pogo plate 63 first makes contact with the movable plate 73. The plate driver 75 detects that a contact between the pogo plate 63 and the movable plate 63 has been made and in response retracts the movable plate 73 to the inside of the terminal case, thereby enabling the pogo plate 63 protruded from the pogo case 210 to enter the receiving portion 71. The distance by which the movable plate 73 is retracted in the terminal case may correspond to the thickness t of the pogo plate 63. While the pogo plate 63 enters at the terminal receiving portion 71 along the movable plate 73, the contact between the pogo plate 63 and the movable plate 73 is maintained.

When the pogo plate 63 is separated from the movable plate 71 (e.g., by a user disconnecting the pogo connector 200 from the terminal 100), the plate driver 75 moves the movable plate 73 by actuating the moving shaft 74 and returns the movable plate 73 to a state in which the movable plate 73 is substantially flush with a surface of the terminal case.

Figure 6:
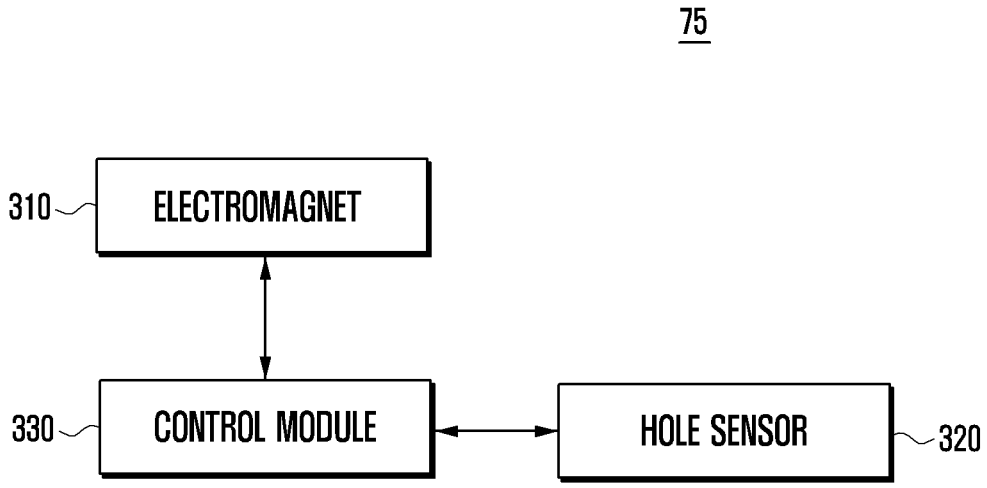
FIG. 6 is a block diagram of a plate driver structure according to aspects of the present disclosure.

FIG. 6 is a diagram of the plate driver 75 described with reference to FIGS. 4 and 5 in accordance with one aspect of the disclosure. Referring to FIG. 6, the plate driver 75 of the present example includes an electromagnet 310, sensor 320, and control module 330. The electromagnet 310 is connected to the moving shaft 74, the plate driver 75 changes an electromagnetic state of the electromagnet 310 according to the control of the control module 330, thereby enabling elongation or retraction of the moving shaft 74. In some instances, the plate driver 75 may detect that the pogo connector 200 has made (or is about to make) contact with the terminal 100 by using the sensor 320 and actuate the movable plate 73 in response. More particularly, when the pogo connector 200 approaches, the sensor 320 may sense a magnetic force generated in the pogo plate 63 provided in the pogo connector 200 and feed a corresponding signal to the control module 330. Although in this example the sensor 320 is a Hall Effect sensor, in other examples any suitable type of sensor can be used.

Responsive to signals from the sensor 320, the control module 330 controls the electromagnet 310 to increase or shorten the length of the moving shaft 74. When the length of the moving shaft 74 is extended or shortened by the electromagnet 310, the movable plate 73 connected to the moving shaft 74 moves to the outside or the inside of the terminal case, thus enabling the pogo fastening portion 272 and the terminal fastening portion 172 to become coupled in male-female coupling form. The control module 330 may be implemented by using one or more of a processor, a solid state switch, and/or any other suitable type of electronic circuitry.

Figure 7:
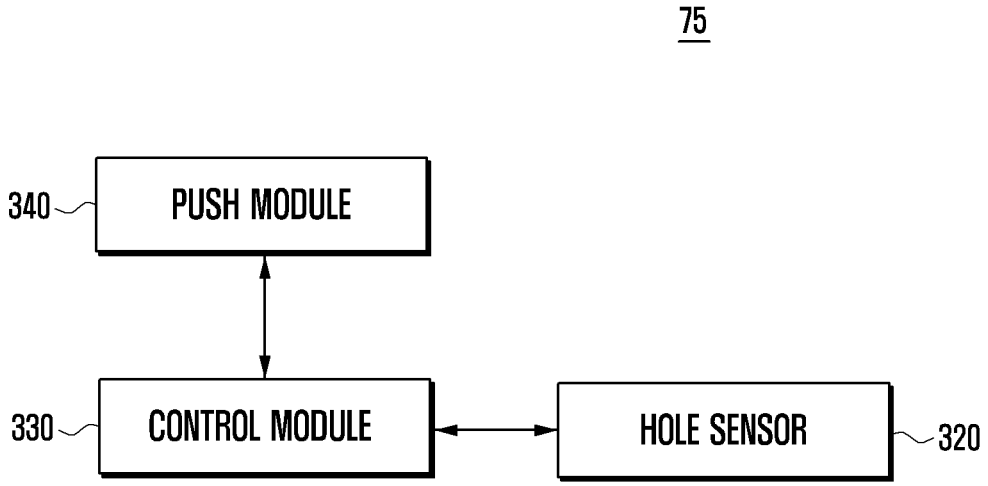
FIG. 7 is a block diagram of another plate driver structure according to aspects of the present disclosure.

FIG. 7 is a diagram of the plate driver 75 described with reference to FIGS. 4 and 5 in accordance with another aspect of the disclosure. In this example, the plate driver 75 includes the sensor 320, control module 330, and a push module 340. The push module includes a motor. In this example, the push module 340 is coupled to the moving shaft 74 and configured to actuate the moving shaft 74 according to the control of the control module 330.

The sensor 320 performs the same function as discussed with reference to FIG. 6. More particularly, the sensor 320 senses a magnetic force (or field) of the pogo plate 63 disposed at the pogo connector 200, when the pogo connector 200 approaches the connection interface 170. When a magnetic force (or a change in magnetic field) is sensed, the sensor 320 feeds a signal indicating the magnetic force (or change in magnetic field) to the control module 330. In response to the signal, the control module 330 controls the push module 340 to move the movable plate 73 to the inside or to the outside of the terminal case. Particularly, when the pogo plate 63 is disposed inside the pogo receiving portion 61, the control module 330 controls the push module 340 to move the movable plate 73 to the outside of the case of the terminal 100, as shown in FIG. 4. When the pogo plate 63 protrudes from a surface of the pogo case 210, as shown in FIG. 5, the control module 330 controls the push module 340 to move the movable plate 73 towards the inside of the terminal case.

In some implementations, the movable plate 71 may be actuated in dependence upon the type of the pogo connector 200 when an attempt is made to mate the pogo connector with the connection interface 170. For example, when the sensor 320 recognizes a type of the pogo connector 200 as a protrusion type in which the pogo plate 63 is protruded from the pogo case 210, the control module 330 controls the electromagnet 310 or the push module 340 to retract the movable plate 71. As another example, when the sensor 320 recognizes a type of the pogo connector 200 as a depression type in which the pogo receiving portion 61 is provided, the control module 330 of the plate driver 75 controls to extend the movable plate 73 (e.g., from the enclosure of the terminal 100).

Although in the above examples the plate driver 75 is actuated by the electromagnet 310 or the push module 340, in other examples, the plate driver may be actuated by using any other suitable actuation device or technique. For example, the plate driver 75 may be configured to move the movable plate 73 based on an oil pressure or pneumatic pressure method, a piezoelectric method, and/or any other suitable type of method.

Although in the above examples, the plate driver 75 uses a Hall effect sensor to determine whether the connector 200 is connected (or being connected), in other examples any suitable type of sensor may be used. Furthermore, in some implementations, the movable plate 73 may be actuated directly by the plate driver 75, without using the moving shaft 74.

Figure 8:
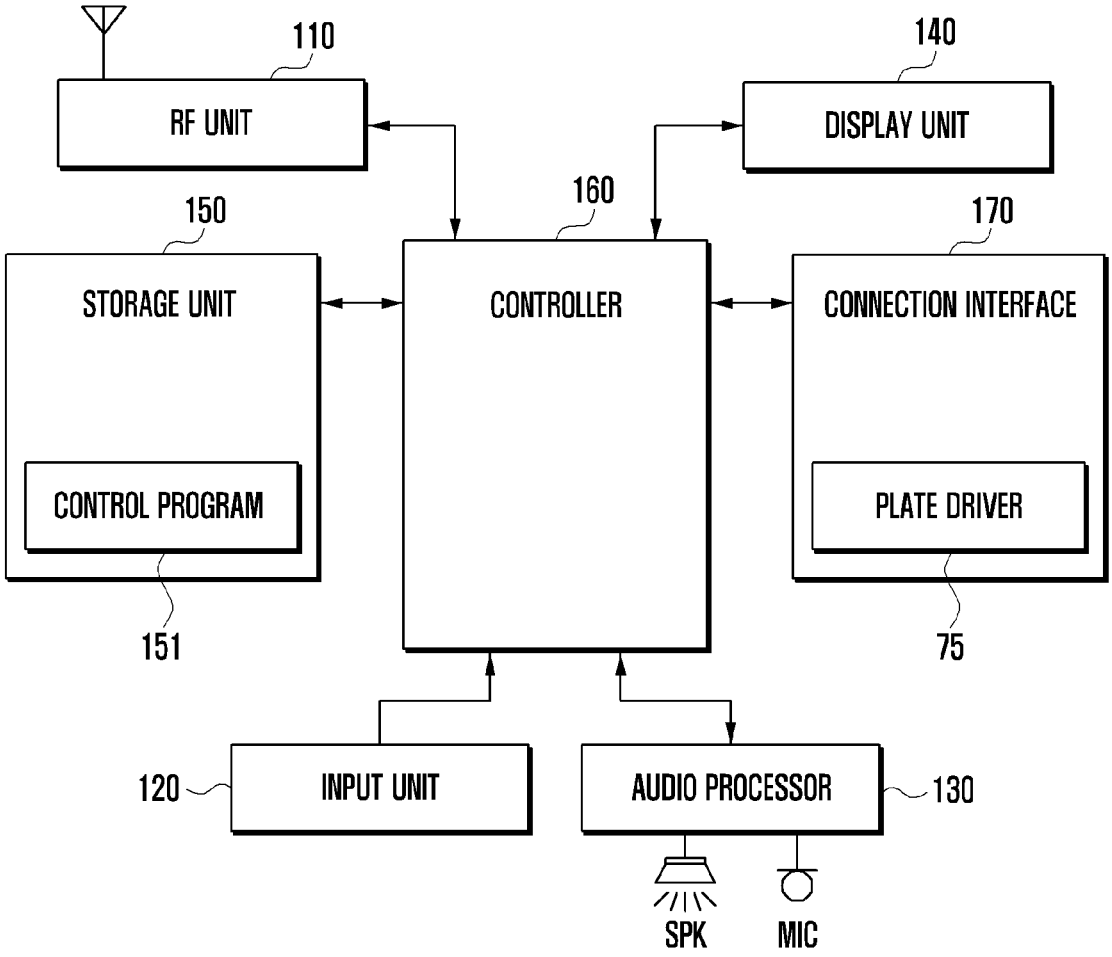
FIG. 8 is a block diagram of a terminal using the connecting system of FIG. 1 according to aspects of the present disclosure.

FIG. 8 is a block diagram illustrating a configuration of the terminal 100 in accordance with aspects of the present disclosure. In this example, the terminal 100 includes a plate driver 75, radio frequency (RF) unit 110, input unit 120, audio processor 130, display unit 140, storage unit 150, controller 160, and connection interface 170.

When the pogo connector 200 contacts the connection interface 170, the terminal 100 controls the plate driver 75 to move the movable plate 73 that is part of the connection interface 170. To perform this function, the terminal 100 may include various adaptations for detecting that the pogo connector 200 is being connected to the connection interface 170. For example, when the pogo connection portion 271 contacts with the terminal connection portion 171 provided in the connection interface 170, a pull-up voltage may change, and the controller 160 of the terminal 100 may cause the plate driver 75 to actuate the movable plate (e.g., retract or extend) based on the pull-up voltage change.

The RF unit 110 supports a communication function of the terminal 100, and when the terminal 100 does not support a communication function, the RF unit 110 may be omitted. When the terminal 100 supports a communication function, the RF unit 110 performs various communication related user functions such as a communication function, data transmitting function, and web connecting function. Particularly, in a state in which the terminal connection portion 171 and the pogo connection portion 271 are electrically connected, the RF unit 110 of the present example forms a communication channel for transmitting information in which an external device connected to the pogo connector 200 provides to another device.

The input unit 120 generates various input signals necessary for manipulating the terminal 100 and may be formed in a specific key form of a button key, side key, and home key or may be provided in a form of a virtual touch pad to support a full touch screen. Here, the virtual touch pad is displayed on the display unit 140 to generate an input signal according to a user touch. When the pogo connector 200 is connected to the connection interface 170, the input unit 120 generates various input signals for controlling an external device corresponding to a main body of the pogo connector 200 or an external device connected to the pogo connector 200 according to a user control and provides the generated input signal to the controller 160. An input signal generated by the input unit 120 may be used for driving the terminal 100 and may be provided to an external device through the pogo connector 200.

The audio processor 130 performs a processing and collection of various audio signals related to the terminal 100. For this, the audio processor 130 includes a speaker SPK for outputting an audio signal and a microphone MIC for collecting an audio signal. The audio processor 130 may be activated or inactivated according to a characteristic of an external device connected to the pogo connector 200. That is, when an external device connected to the pogo connector 200 is a speaker device, the audio processor 130 may intercept an audio output function and selectively activate only a microphone function. When the speaker device connected to the pogo connector 200 includes a microphone function, a microphone function in which the audio processor 130 supports may be intercepted. The audio processor 130 may output effect sound or guide sound corresponding to a connection and separation of the pogo connector 200 and may be omitted according to user setting or selection.

The display unit 140 provides various screen interfaces necessary for operating the terminal 100. In order to support a touch function, the display unit 140 may be formed in a structure including a touch panel and a display panel. The display unit 140 may employ at least one of various types displays such as a liquid crystal display (LCD) or an organic light-emitting diode (OLED). Particularly, when the pogo connector 200 is connected, the display unit 140 of the present example may provide various screen interfaces related to a connection of the pogo connector 200. For example, when the pogo connector 200 is connected, the display unit 140 may output information identifying a type of an external device that is connected to the terminal 100 and/or information about the connected pogo connector 200, and/or any other suitable type of product information. When the pogo connector 200 is a speaker device, the display unit 140 supports a screen interface related to an output control of an audio signal output through the pogo connector 200. Further, when a specific key input signal occurs in a key input unit included in the pogo connector 200 and is transferred, the display unit 140 outputs the transferred key input signal information. Particularly, the display unit 140 of the present example outputs information about a connection state of the pogo connector 200 to an indicator area or a specific screen area.

The storage unit 150 may include any suitable type of volatile or non-volatile memory, such as Random Access Memory (RAM), flash memory, a Solid State Drive (SSD), a hard drive (HD), or EEPROM memory. The storage unit 150 stores various application programs necessary for operation of the terminal 100 or for supporting a function of a specific terminal. For example, the storage unit 150 may store an operation system for operation of the terminal 100, a communication function support program for connecting communication, a program for supporting audiovisual communication function for supporting audiovisual communication when supporting audiovisual communication, and a server connection support program for connecting to an outside server. Particularly, in order to support fastening according to a connection to the pogo connector 200 of the present example, the storage unit 150 stores a control program 151 for controlling the plate driver 75.

The control program 151 may include processor-executable instructions for controlling the operation of the plate driver 75. In operation, the control program 151 controls the plate driver 75, and when the pogo connection portion 271 is connected to the terminal connection portion 171 provided in the connection interface 170, the control program 151 may include a routine performing recognition according to a connection of the pogo connector 200, a routine controlling to move the movable plate 73 to the outside or the inside of the terminal case by controlling the plate driver 75 when the pogo connector 200 is connected, and a routine controlling to return the movable plate 73 to an original position when the pogo connector 200 is separated. The control program 151 may include a routine that collects information about a kind of the pogo connector 200 through the connected pogo connection portion 271 when the pogo connector 200 is connected and that controls movement of the movable plate 73 according to the collected information.

The connection interface 170 includes a terminal connection portion 171 and a terminal fastening portion 172 described with reference to FIGS. 1 to 7 and is connected to the pogo connector 200 to perform signal transmission and reception. The connection interface 170 is fastened to the pogo fastening portion 272 provided in the pogo connector 200 using the terminal fastening portion 172 according to the control of the controller 160, and particularly, the connection interface 170 controls the movable plate 73, having magnetically contacted with the pogo plate 63 provided in the pogo fastening portion 272 to move to the outside or the inside of the terminal case.

As discussed above, the movable plate 73 is actuated by the plate driver 75. The plate driver 75 moves the movable plate 73 to the outside or the inside of the terminal case according to the control of the controller 160. As described above, the plate driver 75 is connected to a moving shaft manipulated to move the movable plate 73 or directly moves the movable plate 73 using a pneumatic pressure or an oil pressure.

The controller 160 may include an ARM-based processor, a MIPS-based processor, an x86-based processor, a Field-Programmable Gate Array (FPGA), and/or any suitable type of processor or other electronic circuitry. The controller 160 performs power supply and distribution necessary for operation of the terminal 100 and a signal output and a processing necessary for operation of the terminal. The controller 160 controls the plate driver 75 for signal transmission and reception according to a contact of the pogo connector 200 and for secure fastening of the pogo connector 200. In more detail, when the pogo connector 200 is connected to the connection interface 170, the controller 160 determines a type of the pogo connector 200 using the terminal connection portion 171 or determines the type of the pogo connector 200 based on information transmitted and received to and from the pogo connector 200. In a pogo connector 200 in which the pogo plate 63 is protruded, the controller 160 controls the plate driver 75 to move the movable plate 73 to the inside of the terminal case. In a pogo connector 200 in which the pogo plate 63 is disposed and engraved at the inside of the pogo receiving portion 61 engraved from a front surface of the pogo case 210, the controller 160 controls the plate driver 75 to protrude the movable plate 73 to the outside of the terminal case. Although in the foregoing description, it has been described that the pogo connector 200 may be either a protrusion type or a depression type, however in other examples, the pogo connector 200 may include an actuated plate that can be either retracted into or extended from the pogo connector, thereby causing the pogo connector to be capable to operate as both a protrusion type of pogo connector and a depression type of pogo connector. In some instances, when a connection of the pogo connector 200 is determined without determining the type of the pogo connector 200, the controller 160 may move the movable plate 73 to a previously defined position. When the pogo connector 200 is separated from the connection interface 170, the controller 160 may cause the movable plate 73 to return to an original position.

Figure 9:
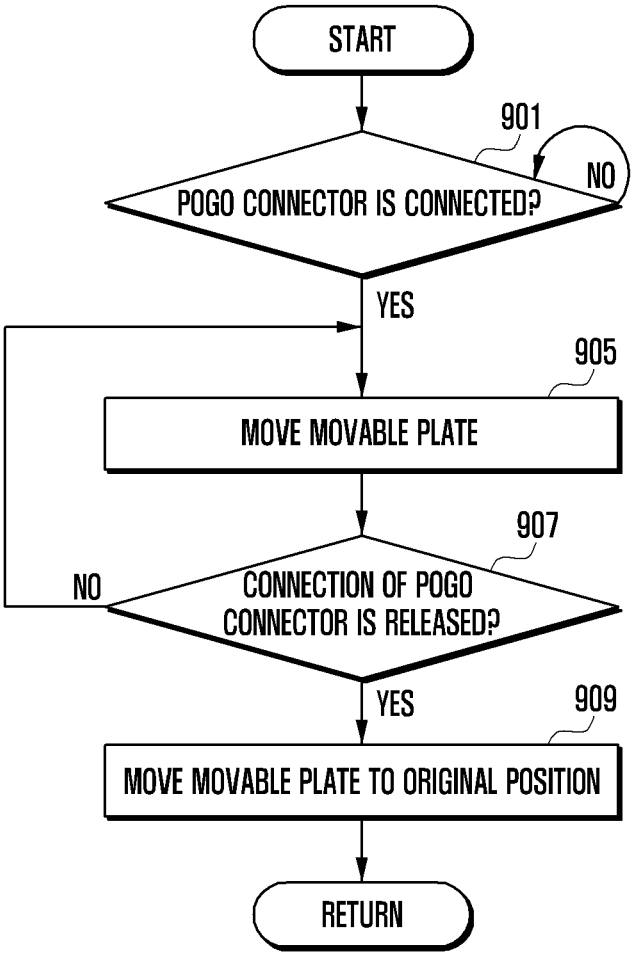
FIG. 9 is a flowchart of a process for operating the connecting system of FIG. 1 according to aspects of the present disclosure.

FIG. 9 is a flowchart of a process for operating a connecting system according to aspects of the disclosure. At step 901, the controller 160 determines whether the pogo connector 200 is connected. In one example, the connection with the pogo connector 200 may be detected by using a sensor. In another example, the connection with the pogo connector 200 may be detected based on a signal received from the connection portion 271. In yet another example, the connection with the pogo connector may be detected based on information transmitted from the pogo connector 200. If the pogo connector 200 is not connected, step 901 is performed again. Otherwise, if the pogo connector is connected, the process proceeds to step 905.

At step 905, the controller 160 moves the movable plate 73 from a present position to a previously defined position. For example, the controller 160 controls the movable plate 73 to protrude by a predetermined length in an outside direction of a terminal case or controls the movable plate 73 to move by a predetermined depth in an inside direction of the terminal case. After the movable plate 73 is moved, the controller 160 performs a function according to a connection of the pogo connector 200.

At step 907, the controller 160 determines whether a connection of the pogo connector 200 is released. If the connection is not released, step 907 is performed again and the controller 160 maintains a position of the movable plate 73 and performs a user function according to a connection of the pogo connector 200 or performs a specific user function. Otherwise, if the connection is released, the process proceeds to step 909.

At step 909, the controller 160 returns the movable plate 73 to its original position by using the plate driver 75. Afterwards, the process returns to step 901. In some implementations, as described above, only when the pogo connector 200 and the connection interface 170 of the terminal 100 are connected, the connecting system 10 according to aspects of the disclosure may extend from or recede in the terminal case 180, thereby coupling the terminal case 180 to the pogo connector 200.

Figure 10:
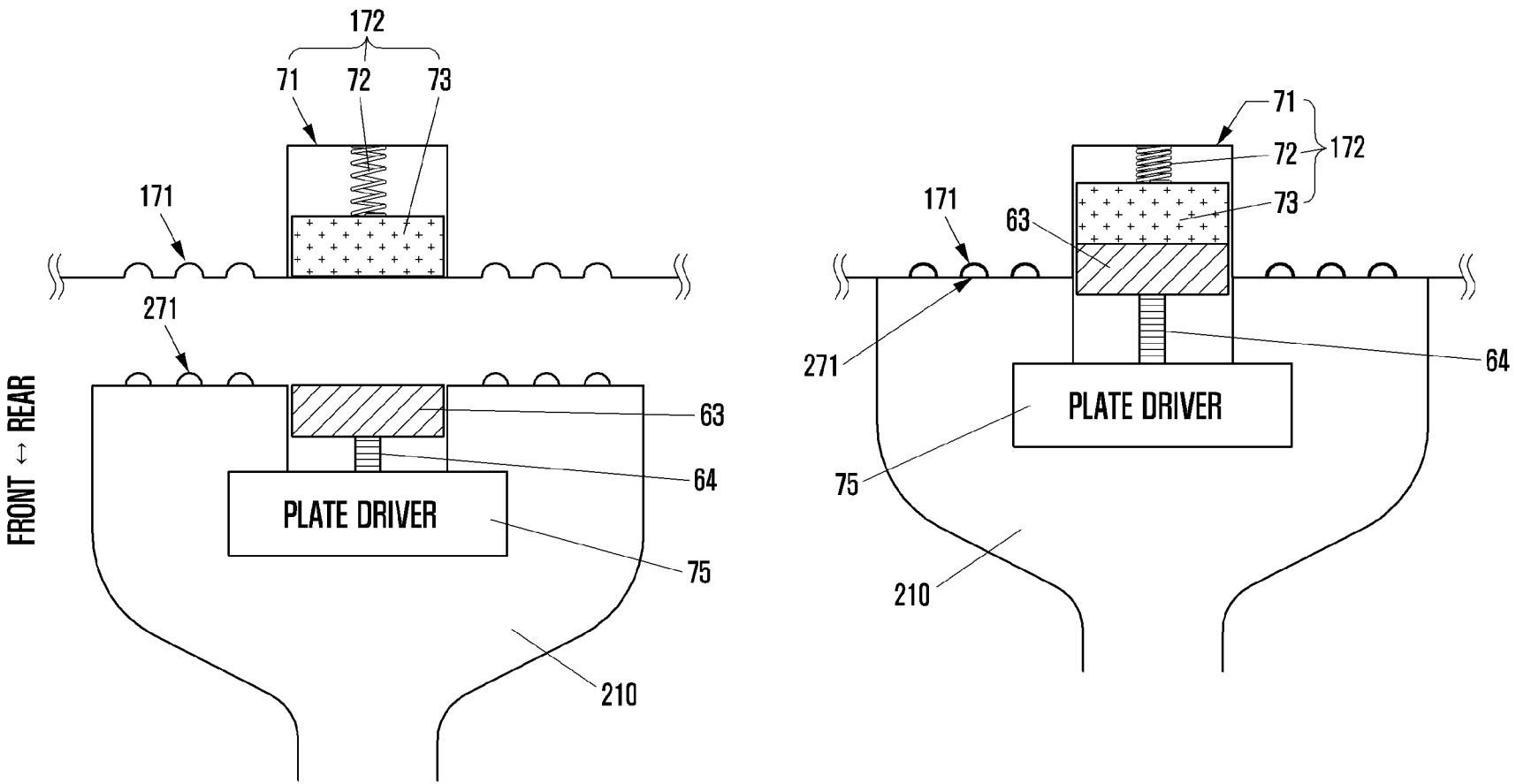
FIG. 10 is a diagram of yet another connecting structure according to aspects of the present disclosure.

FIG. 10 is a diagram of the connecting system 10 according to yet another aspect of the disclosure. In this example, the connecting system 10 includes a connection interface 170 of the terminal 100 including a terminal connection portion 171 and a terminal fastening portion 172 and a pogo connector 200 connected to the connection interface 170. As illustrated, the terminal fastening portion 172 may include the terminal receiving portion 71, elastic member 72, and movable plate 73. The terminal receiving portion 71 moves the movable plate 73 in the front-rear direction, but may be provided in an engraved shape of a form in which an opening may be approximately closed by a front surface of the movable plate 73. The elastic member 72 is disposed between a bottom portion of the terminal receiving portion 71 and the movable plate 73 and provides an elastic force in a predetermined direction to the movable plate 73 based on the terminal receiving portion 71. The movable plate 73 is connected to the elastic member 72, and a front surface of the movable plate 73 is flush with the terminal case surface when the pogo connector 200 is not connected.

The pogo connector 200 includes a pogo connection portion 271 and a pogo fastening portion. The pogo fastening portion includes a pogo plate 63, moving shaft 64, and plate driver 75. Here, the moving shaft 64 and the plate driver 75 provided in the pogo connector 200 may be provided in the configuration described with respect to any of FIGS. 4-9. Power for driving the plate driver 75 may be received from an external device to which the pogo connector 200 is connected (e.g., a power supply unit), or from a power source that is internal to the pogo connector.

When the pogo connector 200 is connected to the connection interface 170, the plate driver 75 of the pogo connector 200 causes the pogo plate 63 to move by actuating the moving shaft 64. Particularly, in order to extend the pogo plate 63 outside of the pogo case 210, the plate driver 75 may manipulate the moving shaft 74. In some instances, a front surface of the pogo plate 63 may be configured to have substantially the same shape as a front surface of the movable plate 73.

In order to detect that the pogo connector 200 is connected to the connection interface 170, the plate driver 75 includes a Hall Effect sensor. In order for the sensor to be able to measure a magnetic force, the pogo plate 63 may be made of a metal material that is not magnetic (or magnetized), and the movable plate 73 provided in the connection interface 170 may be made of a material that is magnetic (or magnetized). Thereafter, the sensor may generate a signal when the movable plate 73 having a magnetic force approaches becomes close to the sensor and feed the generated signal to the plate driver 75. Responsive to the signal, the plate driver 75 may move the pogo plate 63, thereby inserting at least a portion of the pogo plate 63 into the terminal receiving portion 71 of the connection interface 170.

Figure 11:
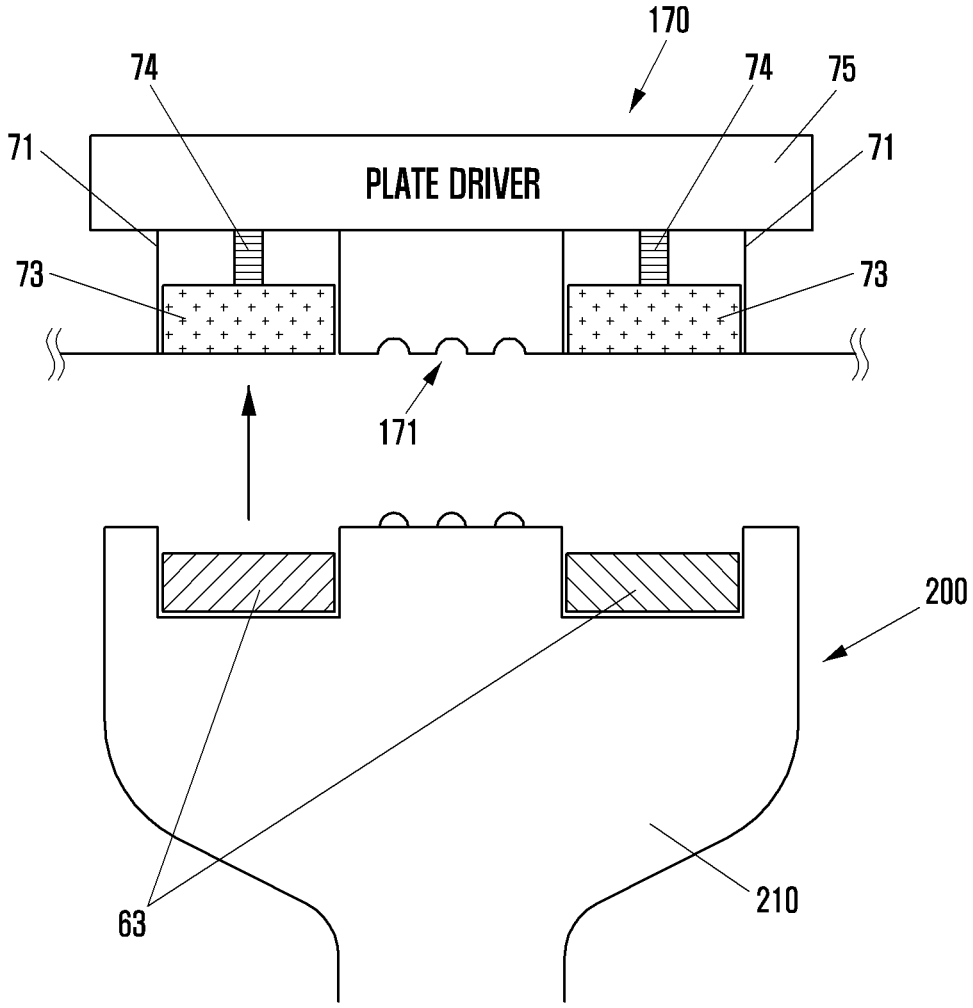
FIG. 11 is a diagram of yet another connecting structure according to aspects of the present disclosure.

FIG. 11 is a diagram of a connecting structure according to yet another aspect of the disclosure. In this example, the connection interface 170 of the terminal 100 includes two terminal receiving portions 71. By arranging the movable plate 73 at each terminal receiving portion 71, the connection interface 170 supports a connection to the pogo connector 200. In order to connect to the connection interface 170 of the terminal 100, the pogo connector 200 may include two receiving portions 61 in which pogo plates 63 are disposed. The terminal connection portion 171 is disposed between the movable plates 73, and the pogo connection portion 271 may similarly be disposed between the pogo receiving portions 61. Such a structure may be applied to a terminal or device in which a more secure fastening is required.

In this example, when the pogo connector 200 is connected, the plate driver 75 controls the movable plates 73 to extend from the terminal case. The extended movable plates 73 are then received at the pogo receiving portion 61 to make contact with the pogo plates 63, which as noted may be magnetic. When the pogo connector 200 is separated, the movable plates 73 may be returned to their original positions, i.e., positions in which the front surfaces of the movable plates 73 are flush with the terminal case.

Figure 12:
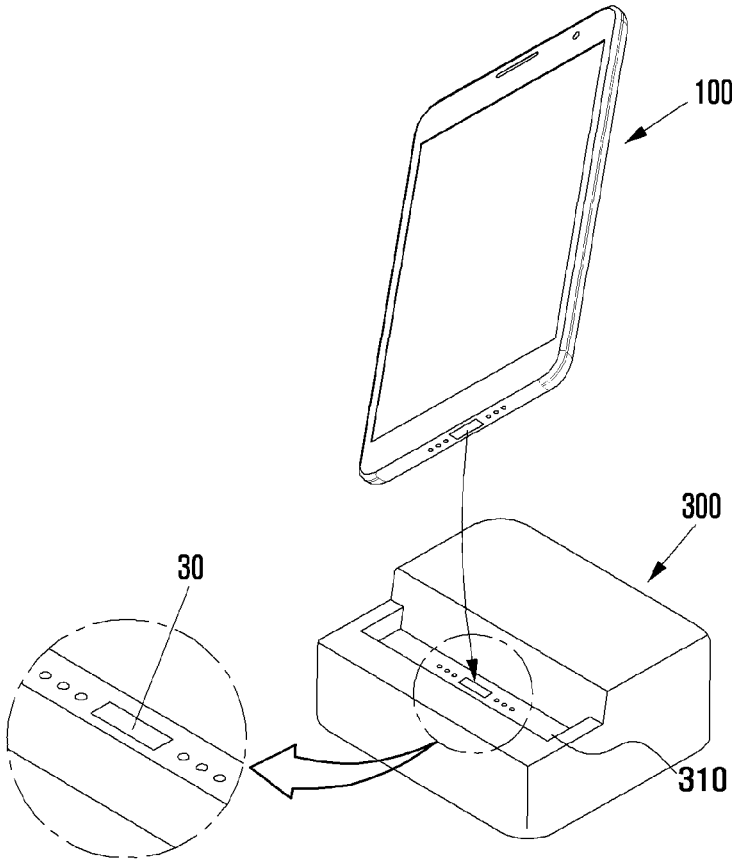
FIG. 12 is a perspective view of a dock connector connecting structure according to aspects of the present disclosure.
Figure 12:
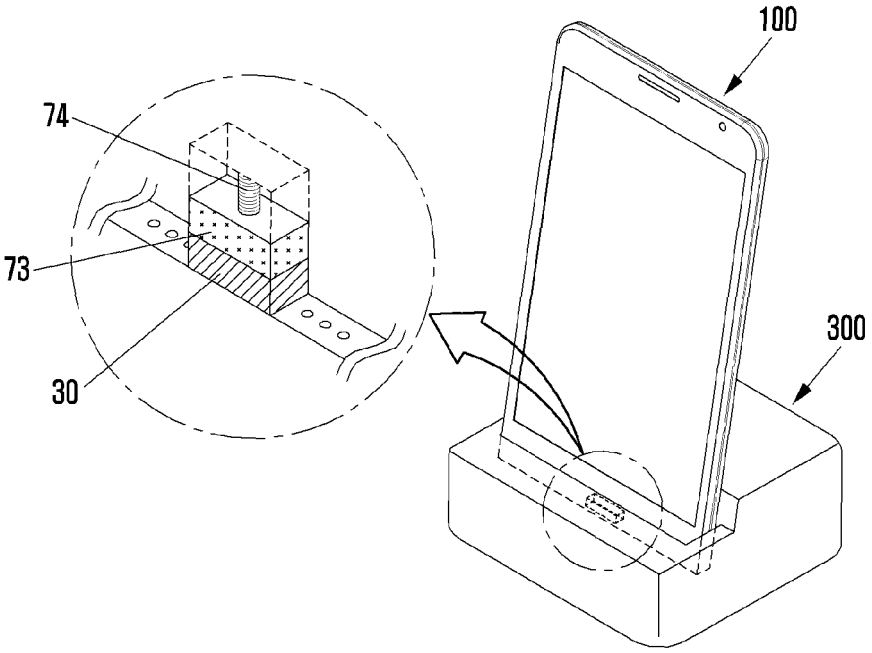

FIG. 12 illustrates a dock connector 300 and a terminal 100 according to aspects of the disclosure. In this example, the dock connector 300 is outfit with the connection interface 170 discussed with respect to any of FIGS. 1-11. In some instances, the connection interface may be disposed in a cradle recess 310 configured to receive the terminal 100. When the terminal 100 is inserted in the dock connector 300, the dock connector 300 controls a dock plate 30 to extend from the surface of the cradle recess, make contact with a movable plate 73, and enter the housing of the terminal 100. Although in this example, the dock plate 30 is actuated, it should be noted that the connection interface 170 may have any one of the configurations discussed with respect to FIGS. 2-11. For example, the dock plate 30 may be operated to recede from the surface of the cradle recess 310 and the movable plate 73 provided in the terminal 100 may be extended from a surface of the terminal case 180 in order for the movable plate 73 to be inserted into a receiving portion of the dock 300.

In some aspects, configurations in which the dock plate 30 is not protruded (or extended) may help reduce the wear of the dock connector 300. Furthermore, in some aspects, the dock connector 300 may include a connection portion that contacts with a terminal connection portion to transmit and receive a power supply signal or a communication data signal, similar to the pogo connector 200.

Furthermore, in some aspects, a connecting system of the present disclosure enables a connection interface structure provided at one side wall of the case of the terminal 100 to be flush with the side wall. When a connection with a connector is attempted, such as the pogo connector 200 or the connector found in the dock 300, a plate in the connection interface may extend or recede in the case of the terminal, so as to provide a secure coupling between the connector interface and the connector. Accordingly, the connecting system 10 may be securely fastened to a connector while having an enhanced external appearance without damage and prevent the injection of foreign substances into the terminal 100.

The terminal 100 may further include various additional modules according to aspects of the disclosure. For example, the terminal 100 may further include constituent elements such as a short range communication module for short range communication, an interface for transmitting and receiving data by a wired communication method or a wireless communication method of the terminal 100, an Internet communication module for performing an Internet function by communicating with an Internet network, a digital broadcasting module for performing a digital broadcasting reception and reproduction function, and a camera module. Further, a specific constituent element may be excluded from the above constituent elements or replaced with another constituent element according to aspects of the disclosure.

Further, the terminal 100 may be any suitable type of electronic device, such as a cellular telephone, (PMP), digital broadcasting player, personal digital assistant (PDA), music player (e.g., MP3 player), mobile game terminal, smart phone, laptop computer, and hand-held PC. As described above, according to a connecting system of a terminal, a terminal connection interface and a connector included in the connecting system, and a method of operating a terminal for supporting the connecting system, an external appearance of the terminal is more simplified, a foreign substance can be prevented from injecting, and a fastening force of a conventional connecting structure can be maintained or improved while deteriorating damage danger.

Although various examples have been provided in the present disclosure, it should be clearly understood that many variations and modifications of these examples may be devised that fall within the spirit and scope of the present disclosure as defined in the appended claims.

The above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

What is claimed is:

1. An electronic device, comprising:

a connecting interface including a connection portion; and a fastening portion comprising a plate that is configured to: (i) be substantially flush with a surface of the electronic device when the connection interface and a connector are not mated, and (ii) extend or recede from the surface of the electronic device when the connection interface and the connector are mated;

wherein the fastening portion further comprises a shaft coupled to the plate and a plate driver configured to actuate the shaft, and wherein the plate driver further comprises at least one of an electromagnet and a motor coupled to the shaft, and an electronic circuitry configured to detect whether the connector is being mated with the connection interface and cause at least one of the electromagnet and the motor to actuate the shaft in a predetermined direction when it is determined that the connector is being mated with the connection interface.

2. The electronic device of claim 1, wherein the fastening portion further comprises a receiving portion for receiving the plate, and an elastic member disposed between a surface of the receiving portion and a surface of the plate.

3. The electronic device of claim 1, wherein the plate driver comprises a sensor, and the electronic circuitry is configured to drive at least one of the electromagnet or the motor based on a signal from the sensor.

4. The electronic device of claim 1, wherein the plate is made from one of a metal material, a magnetized or magnetic material, and a rubber material.

5. The electronic device of claim 1, wherein the plate is configured to return to a state in which the plate is substantially flush with the surface of the electronic device after the connector is separated from the connecting interface.

6. A connector, comprising:

a connection portion; and a fastening portion comprising a plate configured to extend or recede from a surface of the connector when the connector is mated with a connection interface;

wherein the fastening portion further comprises: a receiving portion configured to receive the plate, and an elastic member disposed between a surface of the receiving portion and a surface of the plate, the elastic member being configured to restore the plate to a state in which the plate is substantially flush with the surface of the connector after the connector is disconnected from the connection interface;

wherein the fastening portion further comprises a shaft coupled to the plate and a plate driver configured to actuate the shaft; and wherein the plate includes at east one of a magnetized material, and a magnetic material.

7. The connector of claim 6, wherein the plate driver is configured to move the plate in or out of the receiving portion.

8. A connecting system for use in an electronic device, comprising:

a connection interface comprising a first plate; and a connector for mating with the connection interface, comprising a second plate configured to protrude or extend from a surface of the connector;

wherein the first plate is configured to: (i) be substantially flush with a surface of the electronic device when the connector and the connection interface are not mated, and (ii) extend or recede from the surface of the electronic device during a mating of the connection interface with the connector;

wherein the connection interface comprises a first receiving portion for receiving the first plate, a shaft coupled to the first plate, and a plate driver configured to actuate the shaft and a first elastic member disposed between a surface of the first receiving portion and a surface of the first plate; and wherein the second plate comprises a magnet, so that the first plate is extended or receded during the mating of the connection interface with the connector by a magnetic force of the magnet.

9. The connecting system of claim 8, wherein:

the plate driver is configured to actuate the shaft in a first direction when the connector is from a first type and actuate the shaft in a second direction when the connector is from a second type; and the connector comprises a second receiving portion configured to receive the second plate and a second elastic member disposed between a surface of the second receiving portion and a surface of the second plate.

10. A method of operating a terminal, the method comprising:

detecting a contact between a connection interface of the terminal and a connector; and responsive to detecting the contact, moving a first plate that is substantially flush with a terminal case surface to recede from the terminal case surface and inserting a second plate that is part of the connector into a terminal receiving portion of the connection interface to establish a contact between the first plate and the second plate;

detecting that the connector and the connection interface have become separated, and restoring the first plate to a state in which the first plate is substantially flush with the terminal case surface, wherein the first plate includes one of a magnetized material, magnetic material, and a rubber material.

11. The method of claim 10, wherein detecting the contact between the connection interface of the terminal and the connector comprises sensing a magnetic field of the connector.

12. The method of claim 10, wherein the contact between the connection interface of the terminal and the connector is detected based on a signal received from a terminal connection portion of the connection interface.

* * * * *

UNITED STATES PATENT AND TRADEMARK OFFICE

CERTIFICATE OF CORRECTION

PATENT NO. : 9,088,098 B2
APPLICATION NO. : 14/093770
DATED : July 21, 2015
INVENTOR(S) : Sunlyeong Hwang It is certified that error appears in the above-identified patent and that said Letters Patent is hereby corrected as shown below:

In the claims

Column 14, Claim 6, Line 45 should read as follows:
--...includes at least one...--

Signed and Sealed this
Tenth Day of November, 2015

Michelle K. Lee

Michelle K. Lee
*Director of the United States Patent and Trademark Office*